US005746131A

United States Patent [19]

Henn et al.

[11] Patent Number: 5,746,131

[45] Date of Patent: May 5, 1998

[54] POWDER SPRAYER

[75] Inventors: Manfred Henn, Heidelberg; Maritta Vettermann, Mauer, both of Germany

[73] Assignee: Heidelberger Druckmaschinen AG, Heidelberg, Germany

[21] Appl. No.: 743,539

[22] Filed: Nov. 4, 1996

[30] Foreign Application Priority Data

Nov. 2, 1995 [DE] Germany ..... 295 17 283.5
Jul. 8, 1996 [DE] Germany ..... 196 27 460.5

[51] Int. Cl.[6] ..... B41L 23/22

[52] U.S. Cl. ..... 101/424.2; 101/416.1

[58] Field of Search ..... 101/424.2, 416.1, 101/419, 420, 424.1

[56] References Cited

U.S. PATENT DOCUMENTS

| | | | |
|---|---|---|---|
| 3,053,180 | 9/1962 | Doyle | 101/416.1 |
| 3,114,482 | 12/1963 | Dunaway | 222/328 |
| 4,332,198 | 6/1982 | Schmoeger | 101/424.2 |
| 5,265,536 | 11/1993 | Millard | 101/424.2 |
| 5,443,005 | 8/1995 | Platsch | 101/424.2 |
| 5,535,676 | 7/1996 | Buschulte et al. | 101/416.1 |

FOREIGN PATENT DOCUMENTS

| | | |
|---|---|---|
| 470 585 | 1/1929 | Germany . |
| 1 252 703 | 10/1967 | Germany . |
| 22 07 983 | 8/1973 | Germany . |
| 1 094 898 | 12/1967 | United Kingdom . |

*Primary Examiner*—Edgar S. Burr
*Assistant Examiner*—Anthony H. Nguyen
*Attorney, Agent, or Firm*—Herbert L. Lerner; Laurence A. Greenberg

[57] ABSTRACT

Powder sprayer in a delivery system of a printing press includes a row of powder nozzles extending over a sheet width, and a blower associated with the powder nozzles and aimed in a direction of a travel path of the sheet, the blower being actuatable for generating an air stream, the powder nozzles being disposed in the air stream.

8 Claims, 1 Drawing Sheet

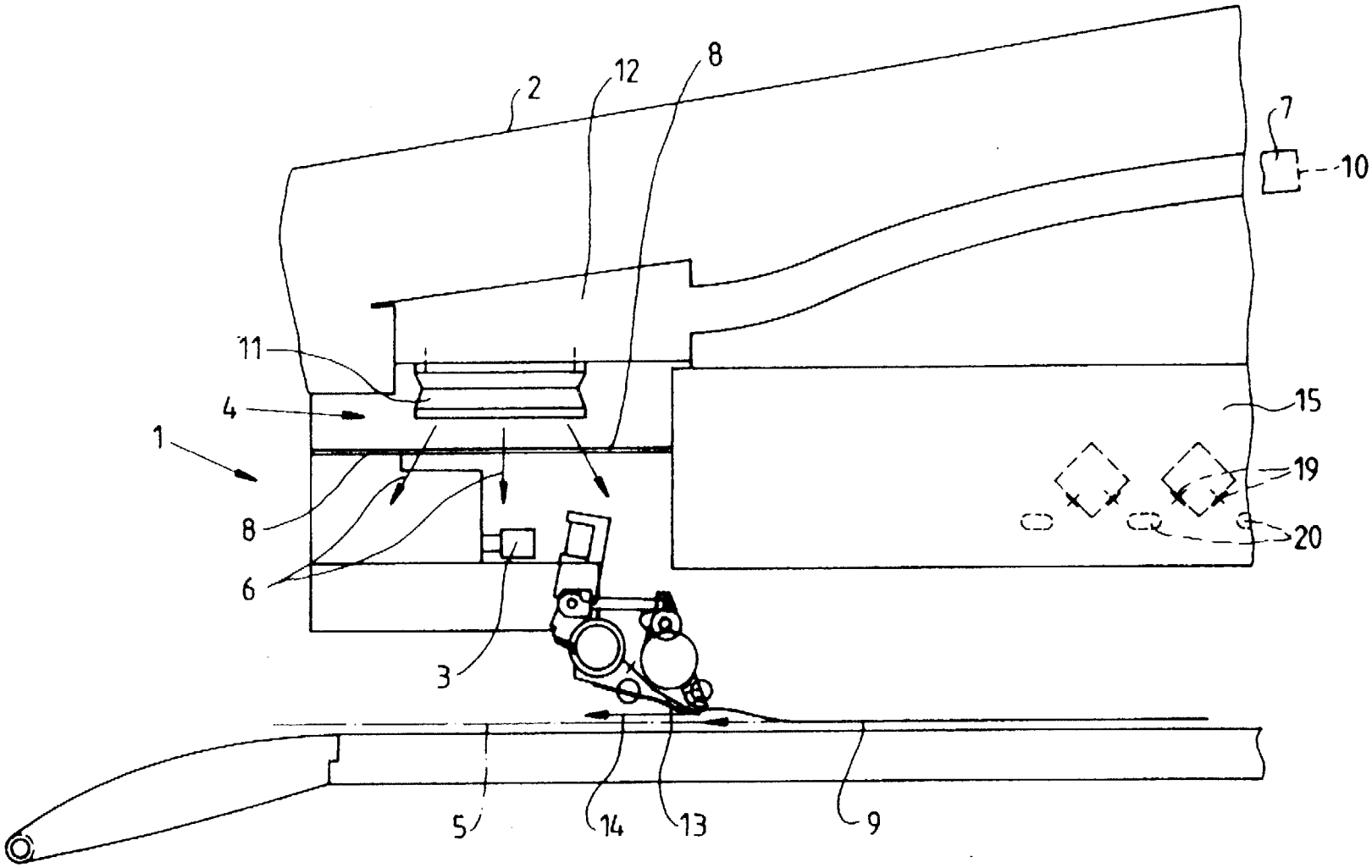
10
7
15
19
20
8
12
2
9
13
14
3
5
11
4
8
6
1

POWDER SPRAYER

BACKGROUND OF THE INVENTION

Field of the Invention

The invention relates to a powder sprayer in the delivery system of a printing press, the powder sprayer having a row of powder nozzles extending over the width of a sheet and a blower associated with the powder nozzles and aimed in a direction of a travel path of the sheet.

In printing presses, printed and/or varnished sheets of paper are deposited in a pile by a delivery system. To prevent the sheets from sticking together, dryers and/or devices for powdering the sheets are provided. A problem develops, however, in that air streams occur, which whisk away the powder directed towards the sheets, so that the powder settles on parts of the delivery system, rather than on the sheets of paper. Such air streams occur, for example, due to the movement of the gripper bars. The problem becomes especially serious if the powder applicator is preceded by dryers, which produce warm and consequently upwardly-directed air streams.

To solve this problem, a brochure of the Weko company entitled "Bestaeubung" (Dusting), page 8, has proposed blowing the powder laterally into a cone of supporting air directed towards the sheet of paper. Although the powder is then carried onto the sheet by the supporting air cone, nevertheless, no mixing of the supporting air with the powder, by which a homogeneous air/powder mixture is attainable, occurs. Turbulence continues to exist, resulting in a non-uniform or uneven powder application and deposit in the delivery system.

SUMMARY OF THE INVENTION

It is accordingly an object of the invention to provide an improved powder sprayer of the type referred to in the introduction hereto so that uniform or even powdering of the sheets is possible with the least possible loss of powder from turbulence.

With the foregoing and other objects in view, there is provided, in accordance with the invention, a powder sprayer in a delivery system of a printing press, the powder sprayer comprising a row of powder nozzles extending over a sheet width, and a blower associated with the powder nozzles and aimed in a direction of a travel path of the sheet, the blower being actuatable for generating an air stream, the powder nozzles being disposed in the air stream.

In accordance with another feature of the invention, the powder sprayer includes an air guide element located between the blower and the powder nozzles for forming the air stream into a laminar air stream.

In accordance with a further feature of the invention, the air guide element is exchangeable.

In accordance with an added feature of the invention, the blower has an air suction inlet located outside the printing press.

In accordance with an additional feature of the invention, the blower has an air suction inlet located inside the delivery system for sucking in powder which has failed to reach a sheet and for returning the sucked-in powder to the air stream.

In accordance with yet another feature of the invention, the air suction inlet is equipped with a filter for trapping coarse particles floating in the air.

In accordance with yet a further feature of the invention, the blower has axial fans.

In accordance with an alternative feature of the invention, the blower has radial fans.

In accordance with yet an added feature of the invention, the blower is equipped with a blow box or manifold chamber.

In accordance with a concomitant feature of the invention, the powder nozzles introduce powder into the air stream only when a sheet is located under the powder sprayer.

An advantage of the invention is that all of the powder is caught by the air stream and a homogeneous air/powder mixture is thereby attainable. In this manner, turbulence is minimized, and less powder is needed. Also markedly avoided thereby is a deposit of powder on parts of the delivery system, or an escape of powder from the printing press.

By locating the air guide element for forming the laminar air stream between the blower and the powder nozzles, an especially homogeneous air stream is generated which, in turn, results in a uniform or even powdering, without swirling or turbulence. The air guide element may be constructed so as to be replaceable or exchangeable. In this way, the air stream can be adapted to the powder which is being used; that is, fine or coarse-mesh air guide elements can be used, depending upon whether fine or coarse powder is used.

One embodiment of the invention provides that the blower have an air aspirator or suction inlet located outside the printing press. This is especially advantageous, if fine or close-mesh air guide elements are used, because due to the sucking in or aspiration being performed outside the printing press, the air does not contain any powder, and the danger of clogging of the air guide element is thus averted.

Another embodiment provides that the blower have an air aspirator or suction inlet located inside the delivery system so that powder which fails to reach a sheet is sucked in or aspirated and thereby returned to the air stream. Due to this embodiment, powder which does not reach the sheet is brought back to the sheet again, thus reducing the consumption of powder and avoiding the deposition of the powder in the press. In this embodiment, however, a fine-mesh air guide element cannot be employed, for the foregoing reasons.

An advantageous feature provides that the air aspirator or suction inlet be equipped with a filter, which traps coarse particles that float in air, such as shreds or scraps of paper.

The blower may have axial fans or radial fans, and may be equipped with a blow box or air manifold chamber which, for example, communicates with an air aspirator or suction inlet or intake located outside the printing press.

Other features which are considered as characteristic for the invention are set forth in the appended claims.

Although the invention is illustrated and described herein as embodied in a powder sprayer, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying single figure of a drawing.

BRIEF DESCRIPTION OF THE DRAWING

The single FIGURE is a diagrammatic side elevational view of a delivery or delivery system of a printing press provided with an exemplary embodiment of the powder sprayer according to the invention.

DESCRIPTION OF THE PREFERRED EMBODIMENTS

Referring now to the single FIGURE of the drawing, there is shown therein a powder sprayer 1 disposed in a delivery system 2 of a printing press. The powder sprayer 1 has a row of powder nozzles 3, only one of which is shown in the figure, which extends over the width of the printing press and thus over any possible width of a sheet. The powder nozzles 3 are located between a blower 4 and a travel path 5 for the sheet, in such a manner that they are disposed approximately in the middle of a conical air stream 6 generated by the blower 4.

To produce a homogeneous air stream 6, in this exemplary embodiment, a row of axial fans 11 is provided, which draw the air from a blow box or air manifold chamber 12 having an air suction inlet or aspirator 7 located outside the printing press. The air suction inlet or aspirator 7 has a filter 10, which traps coarse particles floating in the air, such as shreds or bits of paper. The blower 4 may be provided with an air suction inlet or aspirator 7 within the delivery system 2 so as to suck into the blower 4 any powder which has not reached the sheet 9, and to feed it back into the air stream 6.

Beneath the powder nozzles 3, sheets 9 are transported by grippers 13 on the sheet travel path 5, the grippers 13 moving in the direction of the arrow 14. Before the powdering, the sheets 9 are moved past a dryer 15 provided with air nozzles 19, which apply warm air to the sheets 9, due to the fact that the air leaving the dryer nozzles 19 is moved past heating rods 20.

To generate a laminar air stream 6, an air guide element 8 is provided, which is disposed between the blower 4 and the powder nozzles 3. The air guide element 8 may be formed of a grid of laminations oriented in the flow direction. The powder is introduced into the laminar air stream 6 by the powder nozzles 3 and forms a homogeneous air/powder mixture, which is aimed directly at a sheet 9.

The introduction of powder into the air stream 6 may be adapted to the transport or feeding of the sheets 9 so that only when a sheet 9 is located under the powder sprayer 1 is any powder sprayed thereby. This timing adjustment can be effected by any conventional device.

We claim:

1. Powder sprayer in a delivery system of a printing press, the powder sprayer comprising:

a row of powder nozzles extending over a sheet width;

a blower associated with said powder nozzles and aimed at a travel path of the sheet, said blower being actuatable for generating an air stream, said powder nozzles being disposed in said air stream; and an air guide element located between said blower and said powder nozzles for forming said air stream into a laminar air stream.

2. Powder sprayer according to claim 1, wherein said blower is equipped with a blow box or manifold chamber.

3. Powder sprayer according to claim 1, wherein said air guide element is exchangeable.

4. Powder sprayer according to claim 1, wherein said blower has an air suction inlet located outside the printing press.

5. Powder sprayer according to claim 1, wherein said blower has an air suction inlet located inside the delivery system for sucking in powder which has failed to reach a sheet and for returning the powder to the air stream.

6. Powder sprayer according to claim 4, wherein said air suction inlet is equipped with a filter for trapping coarse particles floating in the air.

7. Powder sprayer according to claim 1, wherein said blower has axial fans.

8. Powder sprayer according to claim 1, wherein said blower has radial fans.

* * * * *